US009844257B2

(12) United States Patent
Kinskey

(10) Patent No.: US 9,844,257 B2
(45) Date of Patent: Dec. 19, 2017

(54) CLIP-ON AIR GUN HOLSTER

(71) Applicant: L.F. Centennial Ltd., Road Town, Tortola (VG)

(72) Inventor: Terrence P. Kinskey, Alpharetta, GA (US)

(73) Assignee: L.F. CENTENNIAL LTD., Road Town, Tortola (VG)

( * ) Notice: Subject to any disclaimer, the term of this patent is extended or adjusted under 35 U.S.C. 154(b) by 0 days.

(21) Appl. No.: 14/628,393

(22) Filed: Feb. 23, 2015

(65) Prior Publication Data

US 2015/0237999 A1 Aug. 27, 2015

Related U.S. Application Data

(60) Provisional application No. 62/001,663, filed on May 22, 2014, provisional application No. 61/942,854, filed on Feb. 21, 2014.

(51) Int. Cl.

| | |
|---|---|
| ***A45F 3/00*** | (2006.01) |
| ***A45C 1/04*** | (2006.01) |
| ***F41C 33/02*** | (2006.01) |
| ***F42B 39/02*** | (2006.01) |
| ***A45F 5/02*** | (2006.01) |

(52) U.S. Cl.
CPC ..... *A45F 5/021* (2013.01); *A45F 2200/0575* (2013.01)

(58) Field of Classification Search
CPC .. A45F 5/021; A45F 2200/0575; B25H 3/006
See application file for complete search history.

(56) References Cited

U.S. PATENT DOCUMENTS

| | | | | | |
|---|---|---|---|---|---|
| 3,157,927 | A | * | 11/1964 | Roden | A45F 5/02 206/259 |
| D240,370 | S | * | 7/1976 | Kuehl | D3/228 |
| D254,759 | S | | 4/1980 | Rodstein | |
| 4,356,854 | A | | 11/1982 | McGee | |
| 4,390,116 | A | | 6/1983 | Fehr | |
| 4,408,706 | A | | 10/1983 | Hurley | |
| 4,496,088 | A | | 1/1985 | Tuthill | |
| 4,729,473 | A | * | 3/1988 | Kulzer | B65D 73/0064 206/477 |
| 4,747,527 | A | * | 5/1988 | Trumpower, II | A41F 9/002 2/311 |

(Continued)

FOREIGN PATENT DOCUMENTS

| | | |
|---|---|---|
| CA | 2755685 | 4/2013 |
| CA | 2800605 | 7/2014 |

*Primary Examiner* — Derek Battisti
(74) *Attorney, Agent, or Firm* — Duane Morris LLP; J. Rodman Steele, Jr.; Gregory M. Lefkowitz

(57) ABSTRACT

A clip-on air gun holster is disclosed. The clip-on air gun holster includes a support arm, having a first end spaced apart from a second end. A first leg extends generally perpendicular to the first end. A second leg extends generally perpendicular to the second end. A bracing arm is spaced apart from the support arm and extends from the first leg to said second leg. The first leg and the second leg each comprise a front piece and a back piece opposite the front piece. Each front piece-back piece pair is connected at an upper end by a loop, so that each front piece-back piece pair is biased toward a resting position.

18 Claims, 11 Drawing Sheets

(56) References Cited

U.S. PATENT DOCUMENTS 4,782,535 A 11/1988 Yewer, Jr. et al.
4,815,640 A 3/1989 Johnson
D302,489 S 8/1989 Stone et al.
4,917,281 A 4/1990 Ostermiller
4,923,105 A 5/1990 Snyder
4,932,576 A 6/1990 Ashley
4,961,522 A 10/1990 Weber
4,962,873 A 10/1990 Schattel
4,966,321 A 10/1990 Outlaw
D313,121 S 12/1990 Dise
4,993,614 A 2/1991 Bonofigl
D316,185 S 4/1991 Seber
D316,186 S 4/1991 Seber
D316,485 S 4/1991 Seber
5,004,136 A 4/1991 Leath
5,014,636 A 5/1991 Seber
D324,309 S 3/1992 Huff
D333,040 S 2/1993 Dancyger
D333,215 S 2/1993 Brown
5,195,667 A 3/1993 Gallant
5,201,448 A 4/1993 Schue
5,209,384 A 5/1993 Anderson
5,248,072 A 9/1993 Jones
D348,777 S 7/1994 Dancyger
D348,778 S 7/1994 Dancyger
D348,982 S 7/1994 Dancyger
D348,983 S 7/1994 Dancyger
5,329,884 A 7/1994 Bell
5,337,511 A 8/1994 Ashbaugh
5,337,933 A 8/1994 Nunez
5,341,975 A 8/1994 Marinescu
D350,229 S 9/1994 Dancyger
D350,849 S * 9/1994 Dancyger ..... D3/224
D355,748 S 2/1995 Dancyger
5,388,740 A 2/1995 Garland
D361,658 S 8/1995 Martin
5,497,923 A 3/1996 Pearson et al.
5,501,379 A 3/1996 Munoz
5,505,356 A 4/1996 Noriega et al.
5,511,703 A 4/1996 Ryerson
5,511,705 A 4/1996 Dreszer
5,531,292 A 7/1996 Bell
5,568,887 A 10/1996 Gollihue et al.
D378,633 S 4/1997 Granito
5,630,536 A 5/1997 Bugnaski
5,639,003 A 6/1997 Utzinger
D381,804 S 8/1997 Dancyger
5,653,337 A 8/1997 Cirigliano
5,673,830 A 10/1997 Matthews
5,730,347 A 3/1998 Finot
5,813,530 A 9/1998 Kornblatt
D406,896 S 3/1999 Dancyger
D410,773 S 6/1999 Case
5,915,610 A 6/1999 Russell
5,941,438 A 8/1999 Price
5,944,242 A * 8/1999 Musarella ..... A45F 5/02 224/270
5,971,101 A 10/1999 Taggart
5,988,315 A 11/1999 Crane
D418,291 S 1/2000 Dancyger
6,015,073 A 1/2000 Wojciak et al.
6,016,944 A 1/2000 Girbert
D423,759 S 5/2000 Dancyger
D423,773 S 5/2000 Dancyger
6,065,658 A 5/2000 Hashimoto
6,070,288 A 6/2000 Luyckx et al.
D428,250 S 7/2000 Reichardt
6,085,952 A 7/2000 Garland
6,102,264 A * 8/2000 Redzisz ..... A45F 5/02 224/197
D431,104 S 9/2000 Dancyger
6,119,909 A 9/2000 Dancyger
6,126,003 A 10/2000 Brouard
6,155,471 A 12/2000 Lichtenberger
6,179,185 B1 1/2001 Dancyger
D437,998 S 2/2001 Williamson
D437,999 S * 2/2001 Williamson ..... D3/228
6,193,119 B1 2/2001 Schwarm
D438,701 S 3/2001 Dancyger
6,213,365 B1 4/2001 Stocke et al.
6,216,931 B1 * 4/2001 Trawinski ..... A45F 3/14 224/255
D443,411 S 6/2001 Snider et al.
6,267,276 B1 7/2001 Cook
D448,162 S 9/2001 Snider
D450,449 S 11/2001 Godshaw et al.
D455,901 S 4/2002 Snider
6,390,348 B1 5/2002 Godshaw et al.
6,398,092 B1 * 6/2002 Ansley ..... A45F 5/02 224/582
6,435,389 B1 8/2002 Sucher
D463,115 S 9/2002 Snider
6,446,852 B1 9/2002 Sorensen et al.
D463,664 S 10/2002 Borsuk
6,478,463 B2 11/2002 Snider
6,487,756 B1 12/2002 Vidal
6,536,590 B1 3/2003 Godshaw et al.
6,550,592 B1 4/2003 Godshaw et al.
6,561,402 B2 * 5/2003 Holland ..... A45F 5/00 224/192
6,568,575 B1 5/2003 Bartholomew
D477,142 S 7/2003 Dancyger
D477,462 S 7/2003 Dancyger
6,592,012 B2 7/2003 Godshaw et al.
6,601,743 B2 8/2003 Godshaw
D481,535 S 11/2003 Cabrera et al.
D482,196 S 11/2003 Cabrera et al.
D482,524 S 11/2003 Cabrera et al.
6,641,011 B1 11/2003 Kahn
6,655,565 B2 12/2003 Godshaw et al.
6,659,321 B2 12/2003 Hartranft et al.
6,662,373 B2 12/2003 Frank
6,675,965 B2 1/2004 Holland et al.
D487,630 S 3/2004 Martin et al.
6,698,632 B1 3/2004 Turner et al.
6,701,534 B2 3/2004 Guibord
6,712,251 B2 3/2004 Godshaw et al.
6,766,532 B1 7/2004 Cabana
D496,787 S 10/2004 Cabrera et al.
D501,078 S 1/2005 Cabana
6,837,373 B2 * 1/2005 Huang ..... A45F 5/021 206/376
6,848,605 B2 2/2005 Dillenberger
6,889,834 B2 5/2005 Ho
6,907,989 B2 6/2005 Ho
6,915,902 B2 7/2005 Brouard
6,991,104 B2 1/2006 Redzisz
6,994,238 B2 2/2006 Estabaya
7,011,241 B2 3/2006 Godshaw et al.
7,055,652 B1 6/2006 Williams
7,077,303 B2 7/2006 Zega
D528,785 S 9/2006 Fraga
D530,506 S 10/2006 Thurner
D531,401 S 11/2006 Thurner
D531,799 S 11/2006 Adams et al.
7,150,345 B2 12/2006 Redzisz
D543,025 S 5/2007 Cicione
7,243,793 B2 7/2007 Ho
D553,350 S 10/2007 Dvorak
D553,362 S 10/2007 Godshaw et al.
7,293,635 B2 11/2007 Repke et al.
7,314,153 B2 * 1/2008 Musarella ..... A45F 5/02 224/247
7,318,542 B2 1/2008 Godshaw et al.
D588,800 S 3/2009 Cicione
D603,164 S 11/2009 Meier et al.
7,658,307 B2 * 2/2010 Skupin ..... A45F 5/004 224/219
D611,663 S * 3/2010 Bergschneider ..... D30/152
7,699,197 B2 4/2010 Panosian et al.
7,784,658 B1 8/2010 Hansen
7,802,680 B2 9/2010 Krebs et al.
D628,382 S 12/2010 Niehaus et al.
7,909,214 B2 3/2011 Gold et al.

(56) References Cited

U.S. PATENT DOCUMENTS

D641,552 S 7/2011 Sosnovsky
7,984,820 B2 7/2011 Dancyger
8,016,173 B2 9/2011 Dvorak
D647,301 S 10/2011 Sosnovsky
8,032,980 B2 10/2011 Basenberg et al.
D648,121 S 11/2011 Dallmann
D648,532 S 11/2011 Sosnovsky
D648,533 S 11/2011 Sosnovsky
8,074,798 B2 12/2011 Williams et al.
8,151,938 B2 4/2012 Klnskey
8,152,037 B2 4/2012 Sabbag
8,177,029 B1 5/2012 Norton et al.
8,220,683 B2 7/2012 Williams
D667,636 S 9/2012 Maglieri
D672,280 S 12/2012 Schurian et al.
D672,556 S 12/2012 Scarabelli
D672,962 S 12/2012 Wang et al.
D676,234 S 2/2013 Moreau et al.
8,376,665 B2 2/2013 Kirby
8,382,373 B1 2/2013 Dancyger
8,403,140 B2 3/2013 Woolery
8,403,141 B2 3/2013 Williams et al.
D684,764 S 6/2013 Sigouin
D696,012 S 12/2013 Hanlon
D699,940 S 2/2014 Robert
D701,045 S 3/2014 Menirom et al.
D703,438 S 4/2014 Lee
8,708,351 B2 4/2014 Kinskey et al.
D704,435 S 5/2014 Moreau et al.
D707,962 S 7/2014 Moreau et al.
8,777,077 B2 * 7/2014 McClain ..... A45F 5/021 224/676
D715,549 S 10/2014 Moreau et al.
8,875,314 B1 11/2014 Panetta
2001/0035736 A1 11/2001 Person
2002/0008128 A1 1/2002 Field
2002/0014507 A1 2/2002 Snider et al.
2002/0096545 A1 7/2002 Chang
2002/0145027 A1 10/2002 Godshaw et al.
2002/0170933 A1 11/2002 Martin
2003/0042160 A1 3/2003 Godshaw et al.
2003/0102346 A1 6/2003 Chen
2003/0197042 A1 10/2003 Warren
2003/0213827 A1 11/2003 Langmuir
2004/0245305 A1 12/2004 Garcia
2008/0082323 A1 4/2005 O'Hair
2005/0133561 A1 6/2005 Kimball
2005/0236454 A1 10/2005 Godshaw et al.
2006/0070901 A1 4/2006 Adams et al.
2006/0102674 A1 5/2006 Godshaw et al.
2006/0102678 A1 5/2006 Bommarito
2006/0144885 A1 7/2006 Smeuninx
2006/0206992 A1 9/2006 Godshaw et al.
2006/0261116 A1 11/2006 Brandeis
2006/0266782 A1 11/2006 Godshaw et al.
2006/0289585 A1 12/2006 Godshaw et al.
2007/0025647 A1 2/2007 Hamlin
2007/0045372 A1 3/2007 Cangemi
2007/0058887 A1 3/2007 Godshaw et al.
2007/0062997 A1 3/2007 Thurner
2007/0125819 A1 6/2007 Kahn
2007/0138227 A1 6/2007 Rickman
2007/0170220 A1 7/2007 Fragassi
2007/0241014 A1 10/2007 Williams
2007/0241158 A1 10/2007 Shima
2007/0241159 A1 10/2007 Chang
2007/0295776 A1 12/2007 Whelan
2008/0017683 A1 1/2008 Votel
2008/0023515 A1 1/2008 Coonan et al.
2008/0029562 A1 2/2008 Hawkins et al.
2008/0093406 A1 4/2008 Logan et al.
2008/0135594 A1 6/2008 Williams
2008/0179370 A1 7/2008 Williams
2008/0185414 A1 8/2008 Conlon
2008/0197756 A1 8/2008 Macias et al.
2008/0202962 A1 8/2008 Brouard
2008/0240624 A1 10/2008 Godshaw et al.
2008/0264992 A1 10/2008 Westling
2008/0314947 A1 12/2008 Gold et al.
2009/0078730 A1 3/2009 Kuny et al.
2009/0108040 A1 4/2009 Corzine
2009/0145711 A1 6/2009 Panosian et al.
2009/0145938 A1 6/2009 Kahn
2009/0242598 A1 10/2009 Dormaar
2009/0294500 A1 12/2009 Brown et al.
2009/0314813 A1 12/2009 Woolery
2010/0044405 A1 2/2010 Albert
2010/0072242 A1 3/2010 Panosian et al.
2010/0176171 A1 7/2010 Araujo
2011/0089057 A1 4/2011 Miller et al.
2011/0132953 A1 6/2011 Kreitzer
2011/0176752 A1 7/2011 Williams et al.
2012/0055894 A1 3/2012 Cabana et al.
2012/0085802 A1 4/2012 Ferrante
2012/0138496 A1 6/2012 Tonelli
2012/0145755 A1 6/2012 Kahn
2012/0168472 A1 7/2012 Mathews
2013/0008933 A1 1/2013 Clifford
2013/0048419 A1 2/2013 Nichols, Jr.
2013/0119100 A1 5/2013 Ito et al.
2013/0119101 A1 5/2013 Hachisuka
2013/0248284 A1 9/2013 Nichols
2013/0299544 A1 11/2013 Moreau et al.
2014/0166516 A1 6/2014 Martinez et al.
2014/0190852 A1 7/2014 Kinskey et al.
2014/0239024 A1 8/2014 Brouard et al.
2014/0262861 A1 9/2014 Crowe et al.

* cited by examiner

CLIP-ON AIR GUN HOLSTER

RELATED APPLICATIONS

This application claims priority to U.S. Application Ser. No. 62/001,663, "Clip-On Air Gun Holster," filed May 22, 2014, and U.S. Application Ser. No. 61/942,854, "Hand Tool Toolbelt," filed Feb. 21, 2014, each of which is incorporated herein by reference in its entirety.

FIELD OF THE INVENTION

The present invention relates generally to clip-on air gun holsters.

BACKGROUND

Air guns are common tools used in many fields, such as, for example, construction, manufacturing, and automotive production. Examples of air guns include nail guns, staple guns, impact guns, pneumatic tools, and other air-operated equipment. Air guns may have significant weight and must be carried by workers over extended shifts. Workers frequently secure air guns to hammer holders or other improvised devices, which can lead to accidents where the air gun falls or causes the worker to lose his balance.

SUMMARY

In various embodiments, a clip-on air gun holster is disclosed. The clip-on air gun holster includes a support arm, having a first end spaced apart from a second end. A first leg extends generally perpendicular to the first end. A second leg extends generally perpendicular to the second end. A bracing arm is spaced apart from the support arm and extends from the first leg to said second leg. The first leg and the second leg each comprise a front piece and a back piece opposite the front piece. Each front piece-back piece pair is connected at an upper end by a loop, so that each front piece-back piece pair is biased toward a resting position.

In some embodiments, a clip-on air gun holster is disclosed. the clip-on air gun holster includes a support arm having a first end spaced apart from a second end. A first leg extends generally perpendicular to the first end. A second leg extends generally perpendicular to the second end. A bracing arm is spaced apart from the support arm and extends from the first leg to the second leg. The first leg and the second leg each comprise a front piece and a back piece opposite the front piece. Each front piece-back piece pair is connected at an upper end by a loop, so that each front piece-back piece pair is biased towards a resting position. The air gun holster is symmetric along a vertical axis. The support arm comprises a first support arm side extending generally perpendicular from the first leg and a second support arm side extending generally perpendicular from the second leg. The support arm includes a support arm strip having a uniform thickness. The support arm strip extends perpendicularly from a first end of the first support arm side to a first end of the second support arm side.

These and other features, objects and advantages of the present invention will become more apparent to one skilled in the art from the following description and claims when read in light of the accompanying drawings.

DETAILED DESCRIPTION

Figure 1:
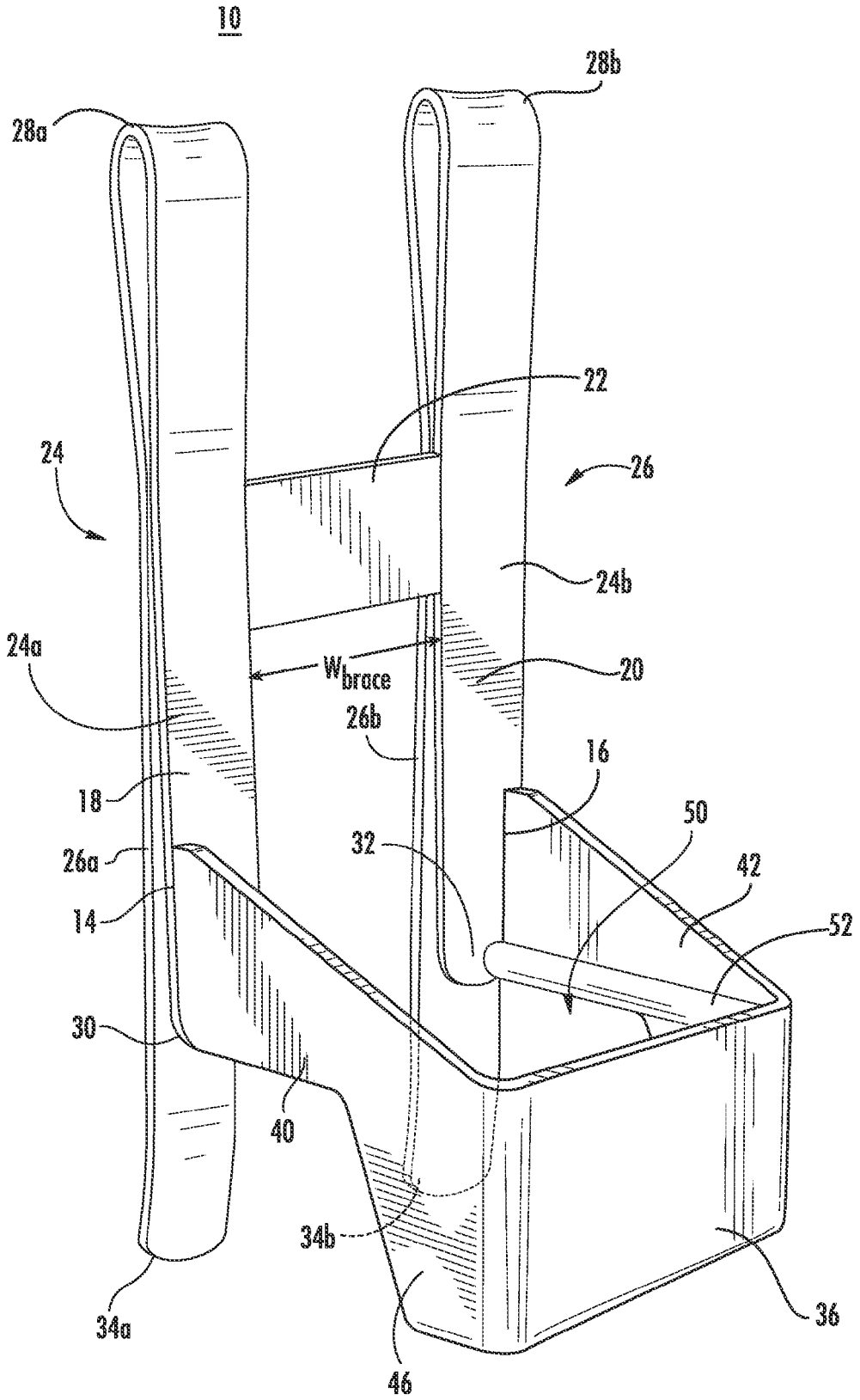
FIG. 1 is a front, perspective view of an embodiment of the clip-on air gun holster as described herein.

As shown in FIGS. 1-13, a clip-on air gun holster 10 adapted for attachment to a piece of material, such as a belt, a waist band, a pocket, or another strip or sheet or material, is disclosed. The clip-on air gun holster 10 can be removably attached to the piece of material by sliding the independent leg clips onto or off of the material. This enables a worker to clip the air gun holster 10 over the waist of their pants, their belt, or over a pocket of a tool pouch or tool box. The clip-on air gun holster 10 can include a support arm 12 that is specially adapted for supporting an air gun adapted with a mounting bracket (e.g., attached at a base of the handle).

In some embodiments, the clip-on air gun holster 10 includes a support arm 12, having a first end 14 spaced apart from a second end 16; a first leg 18 extending generally perpendicular to the first end 14; a second leg 20 extending generally perpendicular to the second end 16; and a bracing arm 22 spaced apart from the support arm 12 and extending from the first leg 18 to the second leg 20. In some embodiments, the first leg 18 and the second leg 20 each comprise a front piece 24*a*, 24*b* and a back piece 26*a*, 26*b* opposite the front piece 24*a*, 24*b*, respectively.

Figure 4:
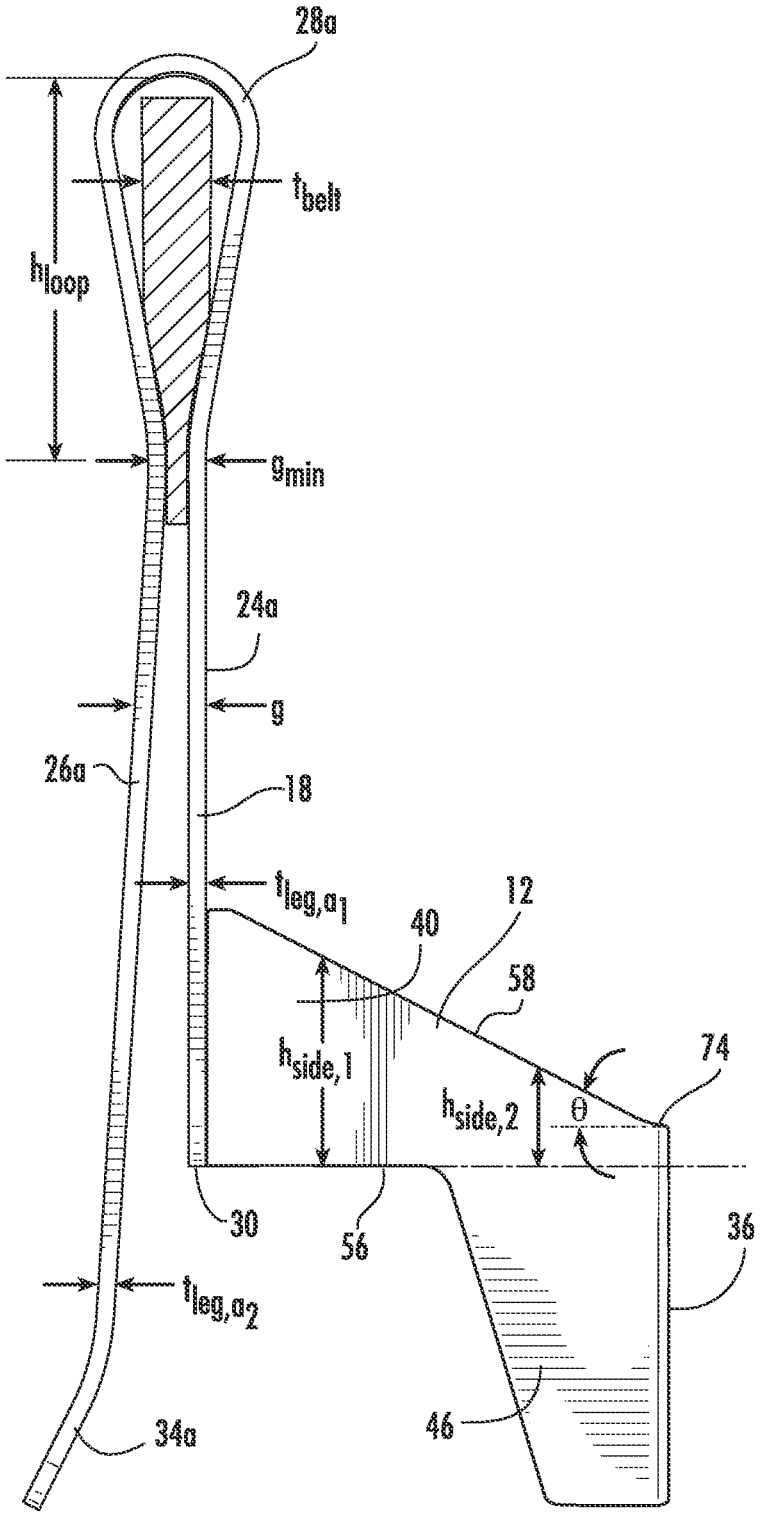
FIG. 4 is a left side view of the clip-on air gun holster.
Figure 5:
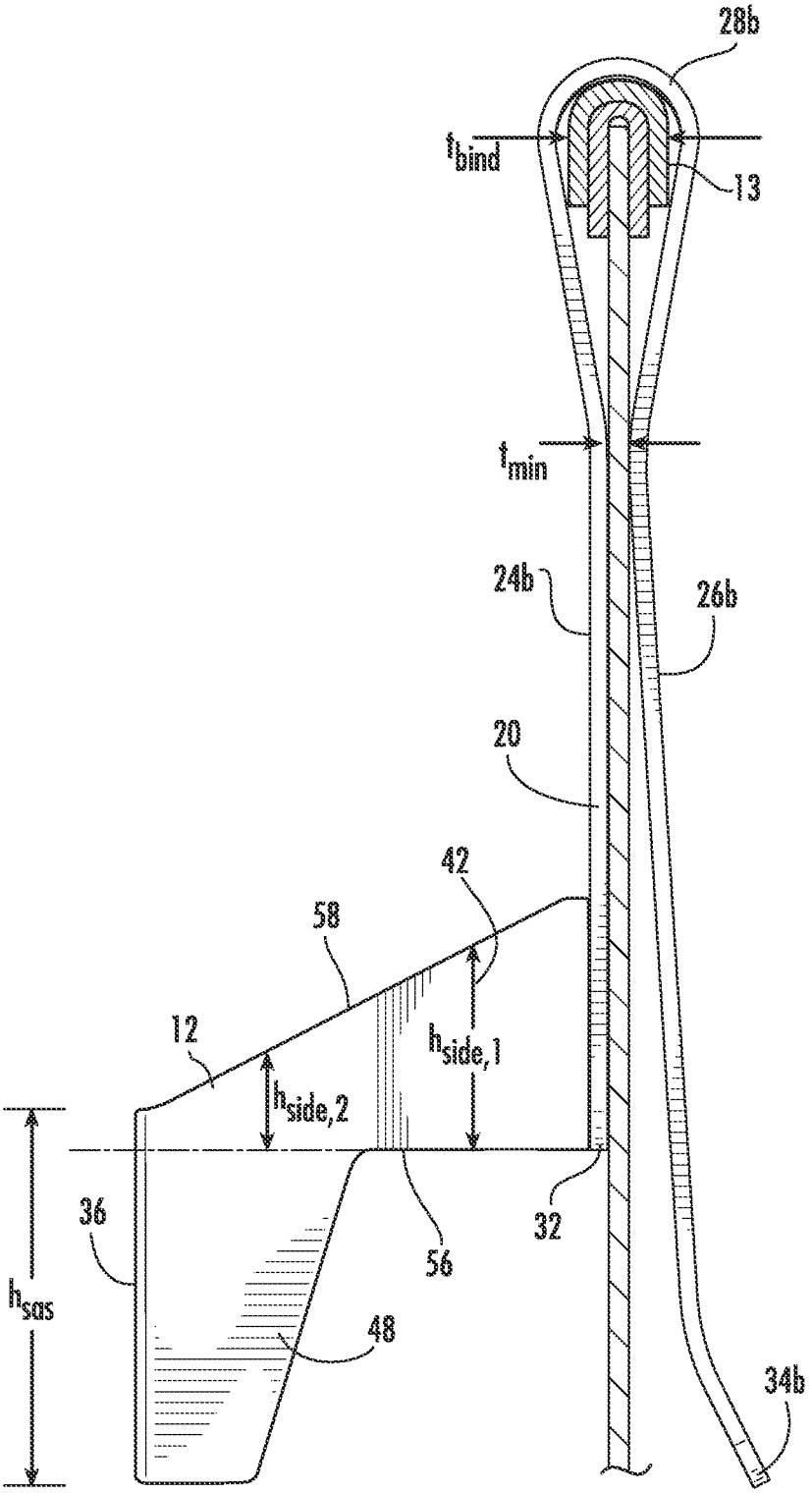
FIG. 5 is a right side view of the clip-on air gun holster.

Each front piece-back piece pair 24, 26 can be connected at an upper end by a loop 28*a*, 28*b*, so that each front piece-back piece pair 24, 26 is biased toward a resting position. In some embodiments, the front piece 24*a*, 24*b* of the leg 18, 20 can contact the back piece 26*a*, 26*b* of the leg 18, 20 in the resting position. An example of a resting position is shown in FIGS. 4 & 5.

In some embodiments, the legs 18, 20 can clip over a material, such as a pocket of the fabric tool bags that are ubiquitous in the industry. FIG. 5 shows the clip-on tool holster 10 attached over a fabric pocket sheet (P) with a binding (B), with the pocket in cross-section. As can be seen the binding (B) fits within the loop 28*b* and is held in place, in part, because the narrowest gap ($g_{min}$) between the front and back portions 24*b*, 26*b* is narrower than the thickness of the binding (B). In some embodiments, in the resting position, the interior (height and width) of the loop can be large enough to receive a binding or belt, while the narrowest gap ($g_{min}$) can be less than a horizontal thickness ($t_{bind}$) of a pocket binding or, as in FIG. 4, the horizontal thickness ($t_{belt}$) of a belt. This allows the clip-on air gun holster 10 to clip over or onto articles, including, but not limited to, belts and pocket bindings.

In some embodiments, the minimum gap (gmin) can be 0 (i.e., the front portion and back portion touch), while the minimum gap (gmin) can be greater than 0 in other embodiments. In some embodiments, the minimum gap (gmin) can be at least 1/16", or at least 1/8". In some embodiments, the minimum gap (gmin) can be 1/2" or less, or 1/3" or less, or 1/4" or less.

In some embodiments, the first loop 28*a*, the second loop 28*b*, or both, are formed from an elastic material. In some embodiments, the first leg 18, the second leg 20, or both, are formed by an elastic material. Examples of elastic materials useful for use in the clip-on air gun holster 10 described herein include pre-hardened metal (e.g., steel), annealed metal (e.g., annealed steel), plastic, and other similar materials, such as those useful for making springs.

In some embodiments, the front piece 24*a*, 24*b*, loop 28*a*, 28*b*, and back piece 26*a*, 26*b* of a leg 18 and/or 20 are formed from a strip of elastic material. In some embodiments, the legs 18, 20 and the bracing arm 22 are formed from separate strips of elastic material. In such embodiments, an intermediate portion of each leg 18, 20 can be welded to an opposite end of the bracing arm 22 (e.g., along edges of the components 18, 20, 22).

In some embodiments, both legs 18, 20 and the bracing arm 22 are formed from a single piece of elastic material. For example, the legs 18, 20 and the bracing arm 22 can be formed (e.g., cast or molded) as a single piece. In some embodiments, the legs 18, 20 and the bracing arm 22 can be cast with a loop. In other embodiments, the legs 18, 20 and the bracing arm 22 can be cast as a flat piece, then bent to form the loop, before being annealed to create the elastic clip structure described herein.

In some embodiments, the material forming the first leg 18 and the material forming the second leg 20 have a uniform leg thickness (t). In some embodiments, the bracing arm 22 is formed of a material that has a uniform strip thickness ($t_{BA}$). In some embodiments, the thickness ($t_{leg}$) of the first and second legs 18, 20 is approximately the same as the thickness of the bracing arm 22. In some embodiments, the average thickness of the first and second legs 18, 20 and the bracing arm 22 varies by less than 20% from the mean thickness of the three, or by less than 10% from the mean thickness of the three. As used herein, "uniform thickness" refers to an average thickness plus or minus a tolerance of less than 10% or less than 0.1".

In some embodiments, a height ($h_{clip}$) from the top of the loop 28 to the support arm sides 40, 42 is at least 1/4 inch, or at least 3/4 inch, or at least 1 inch, or at least 1.25 inches. In some embodiments, a height ($h_{clip}$) from the top of the loop 28 to the support arm sides 40, 42 is 2 inches or less, or 1.75 inches or less, or 1.5 inches or less, or 1.25 inches or less.

Figure 2:
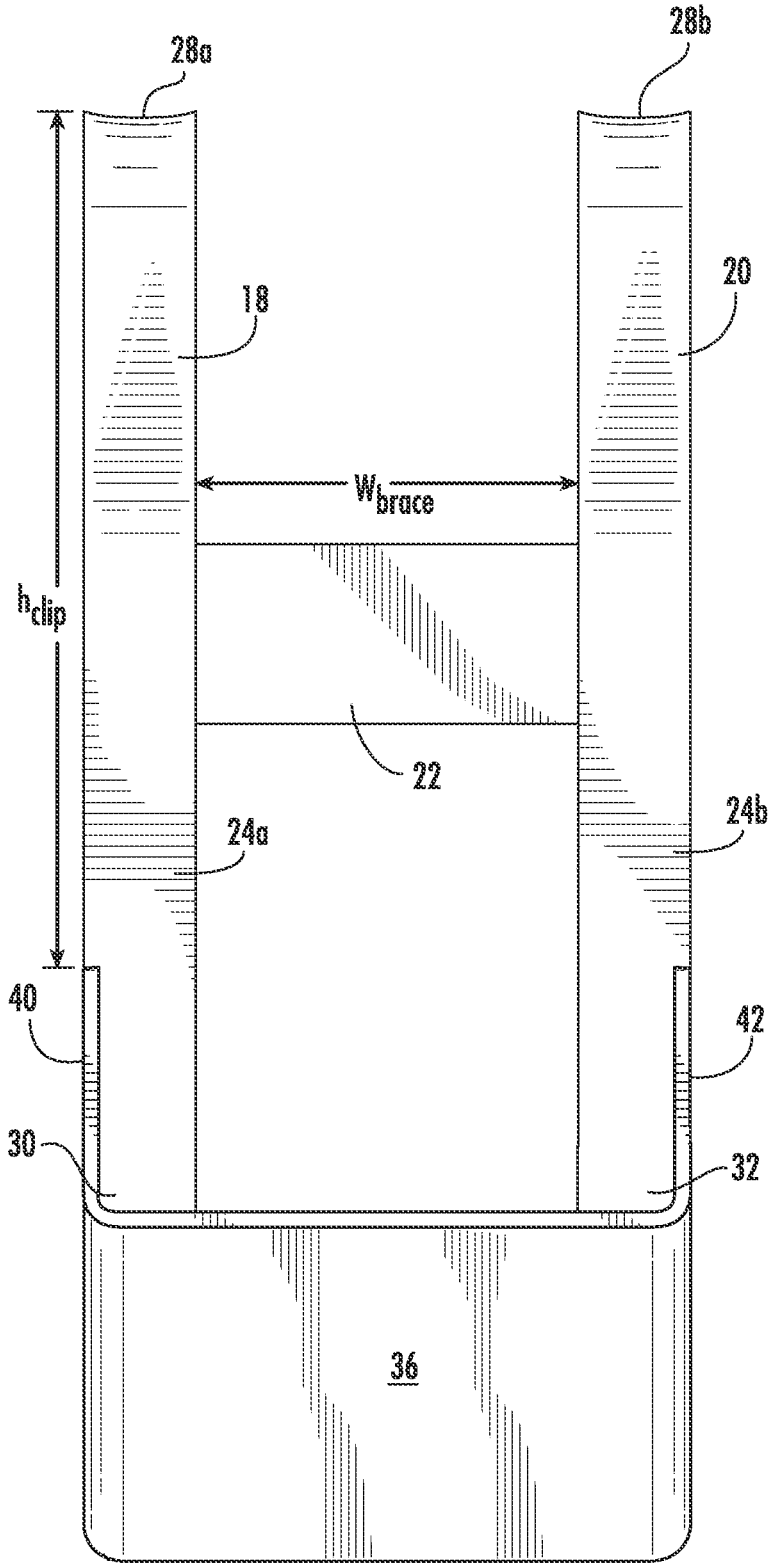
FIG. 2 is a front view of the clip-on air gun holster.
Figure 3:
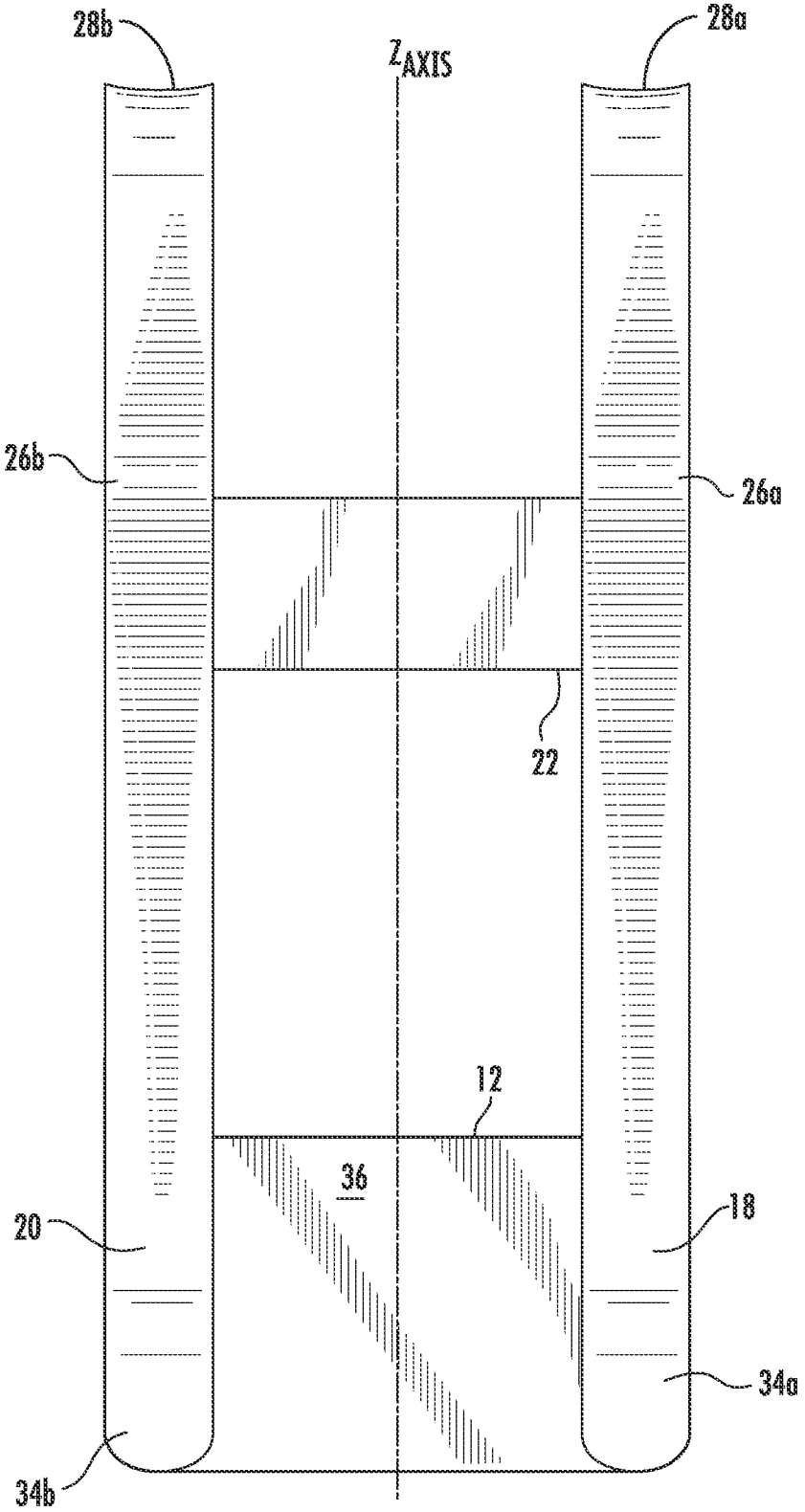
FIG. 3 is a back view of the clip-on air gun holster.

In some embodiments, the first leg 18 is coupled to the first end 14 at a lower end 30 of the front piece 24*a* of the first leg 18, and the second leg 20 is coupled to the second end 16 at a lower end 32 of the front piece 24*b* of the second leg 20. In some embodiments, as shown in FIGS. 1-3, the bracing arm 22 is coupled to and extends from the front piece 24*a* of the first leg 18 to the front piece 24*b* of the second leg 20, and the bracing arm 22 is vertically between the support arm 12 and the loops 28*a*, 28*b*.

In some embodiments, the bracing arm 22 can be 0.5 to 3 inches wide ($w_{brace}$). In some embodiments, the bracing arm 22 can be 0.75 to 2.25 inches wide, while the bracing arm can be 1 to 2 inches with in other embodiments.

In some embodiments, the back pieces 26*a*, 26*b* of the first and second legs 18, 20 are not connected. As best shown in FIG. 3, the back pieces 26*a*, 26*b* are not connected, while the front pieces 24*a*, 24*b* of the first and second legs 18,20 are connected by the bracing arm 22 and the support arm 12. More specifically, in some embodiments, the lower ends 34*a*, 34*b* of the back pieces 26*a*, 26*b* of the first and second legs 18, 20 are not connected.

In some embodiments, the gap (g) between the front and back pieces 24, 26 of each leg is narrowest ($g_{min}$) at the transition between the loop 28 and the front and back pieces 24, 26. In some embodiments, the gap (g) between the front and back pieces 24, 26 of each leg 18, 20 is narrowest ($g_{min}$) between the loop and said support arm.

In some embodiments, as shown in FIG. 3, the air gun holster 10 is symmetric along a vertical axis ($Z_{axis}$). Examples of such embodiments are shown in FIGS. 1-13.

In some embodiments, the support arm 12 comprises a support arm strip 36 having a uniform support arm strip thickness ($t_{SAS}$). The support arm strip 36 includes support arm sides 40, 42.

In some embodiments, the support arm 12 includes a first support arm side 40 extending generally perpendicular from the first leg 18, a second support arm side 42 extending generally perpendicular from the second leg 20. The support arm strip 36 extends from a distal end of the first support arm side 40 to a distal end of the second support arm side 42. The support arm strip 36 can be perpendicular to both the first support arm side 40 and the second support arm side 42. In some embodiments, the first support arm side 40, the support arm strip 36, and the second support arm side 42 are formed of a continuous strip of material.

In some embodiments, the length ($L_{proj}$) of the first support arm side 40 and the second support arm side 42 can, independently, be between 0.25 inches and 2.5 inches. In some embodiments, the length ($L_{proj}$) of the first support arm side 40 and the second support arm side 42 can, independently, be at least 0.25 inches, at least 0.5 inches, at least 0.75 inches, or at least 1 inch. In some embodiments, the length ($L_{proj}$) of the first support arm side 40 and the second support arm side 42 can, independently, be 3 inches or less, 2.5 inches or less, 2 inches or less, 1.75 inches or less, 1.5 inches or less, or 1.125 inches or less.

In some embodiments, the first support arm side 40 and the second support arm side 42 can, independently, have a greater height, $h_{side1}$, closer to the front pieces 24*a*, 24*b* of the legs 18, 20 and a smaller height, $h_{side2}$, closer the support arm strip 36. In some embodiments, the bottom edges 56 of the first support arm side 40 and the second support arm side 42 can, independently, be horizontal and the top edge 74 of the support arm strip 36 can also be horizontal. In some embodiments, the top edges 58 of the first support arm side 40 and the second support arm side 42 can, independently, be angled with respect to the top edge 74 (and/or horizontal) of the support arm strip 36. The angle (8) between the top edge 74 of the support art strip 36 (or horizontal) and either of the first and second support arm sides 40, 42 can be at least 5°, or at least 10°, or at least 15°, or at least 20°.

Figure 6:
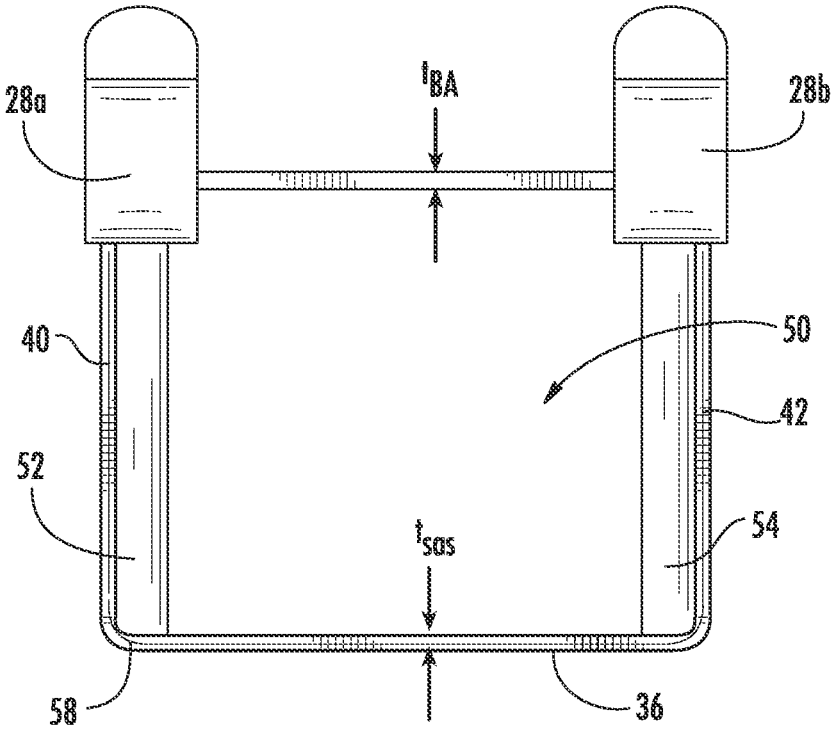
FIG. 6 is a top view of a clip-on air gun holster where the support arm strip is the transverse member.
Figure 7:
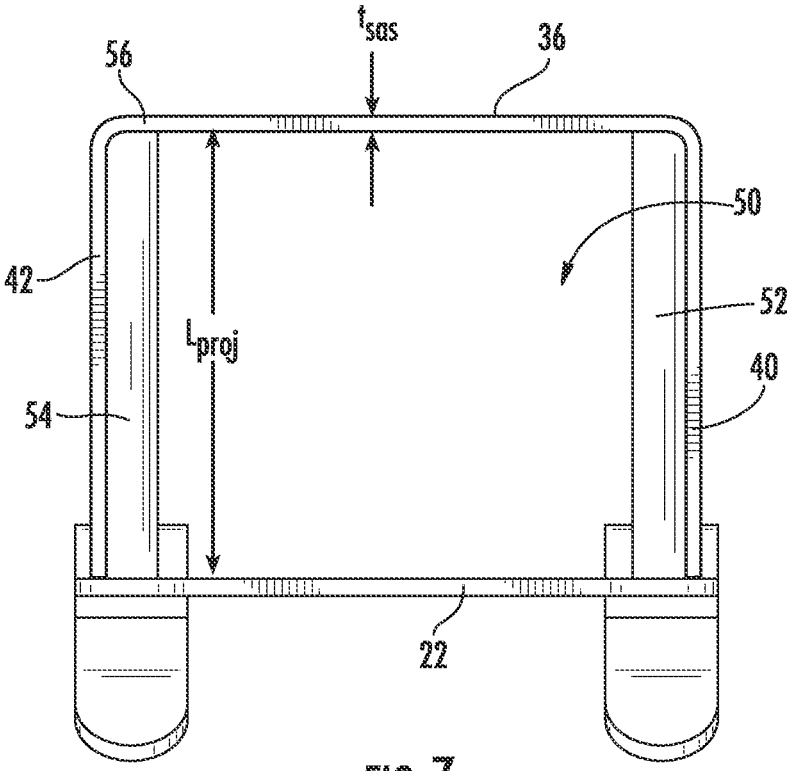
FIG. 7 is a bottom view of the clip-on air gun holster of FIG. 6.

In some embodiments, as best seen in FIGS. 6 & 7, the support arm strip 36 and the support arm sides 40, 42 have a uniform support arm strip thickness ($t_{SAS}$). In some embodiments, the support arm sides 40, 42 may have a greater thickness than the support arm strip 36. In some embodiments, the support arm strip 36 extends generally perpendicular to the first support arm side 40, the second support arm side 42, or both 40, 42. In some embodiments, as best shown in FIGS. 6 & 7, the first support arm side 40, the second support arm side 42, and the support arm strip 36 are formed from a single continuous strip of material.

As best shown in FIG. 7, in some embodiments, the support arm 12 includes a first support arm side 40 extending generally perpendicular from the first leg 18 and a second support arm side 42 extending generally perpendicular from the second leg 20, where the support arm strip 36 extends from a distal end of the first support arm side 40 to a distal end of the second support arm side 42. In some embodiments, the first support arm side 40, the second support arm side 42, and the support arm strip are not formed from a single continuous strip with a generally uniform cross-section, but the support arm strip 36 is a sheet of material with a generally uniform thickness ($t_{SAS}$). In such embodiments, the support arm strip 36 may be welded to or otherwise joined to the distal ends of the first support arm side 40 and the second support arm side 42.

In some embodiments, a first support arm strip side 46 can extend at least partially along the first support arm side 40 and a second support arm strip side 48 can extend at least partially along the second support arm side 42. The first support arm strip side 46 and the second support arm strip side 48 can be continuously formed with the support arm strip 36.

In some embodiments, a first projection 50 can extend along the first support arm side 40. In some embodiments, a second projection 52 can extend along the second support arm side 42. The first projection 50 and the second projection 52 can, independently, be formed of bar with uniform cross section. In some embodiments, the first projection 50 and the second projection 52 can extend, independently, any length less than or equal to the length of the respective first support arm side 40 and the second support arm side 42.

As shown in the figures, the support arm strip 36 can be generally flat. The support arm strip 36 can have a height ($h_{SAS}$) of 0.5 to 6 inches, in some embodiments. In some embodiments, the support arm strip height ($h_{SAS}$) can be at least 0.5 inches, or at least 0.75 inches, or at least 1 inch, or at least 1.125 inches, or at least 1.25 inches. In some embodiments, the support arm strip height ($h_{SAS}$) can be 5 inches or less, or 4 inches or less, or 3 inches or less, or 2 inches or less. In some embodiments, the support arm strip height ($h_{SAS}$) can be generally uniform between the first support arm side 40 and the second support arm side 42.

As shown in FIGS. 1, 4, 5, 8 & 9, the support arm strip sides 40, 42 can include angled edges. This can be particularly helpful for maintaining an air gun attached to the clip-on air gun holster 10 in a readily accessible position.

Figure 9:
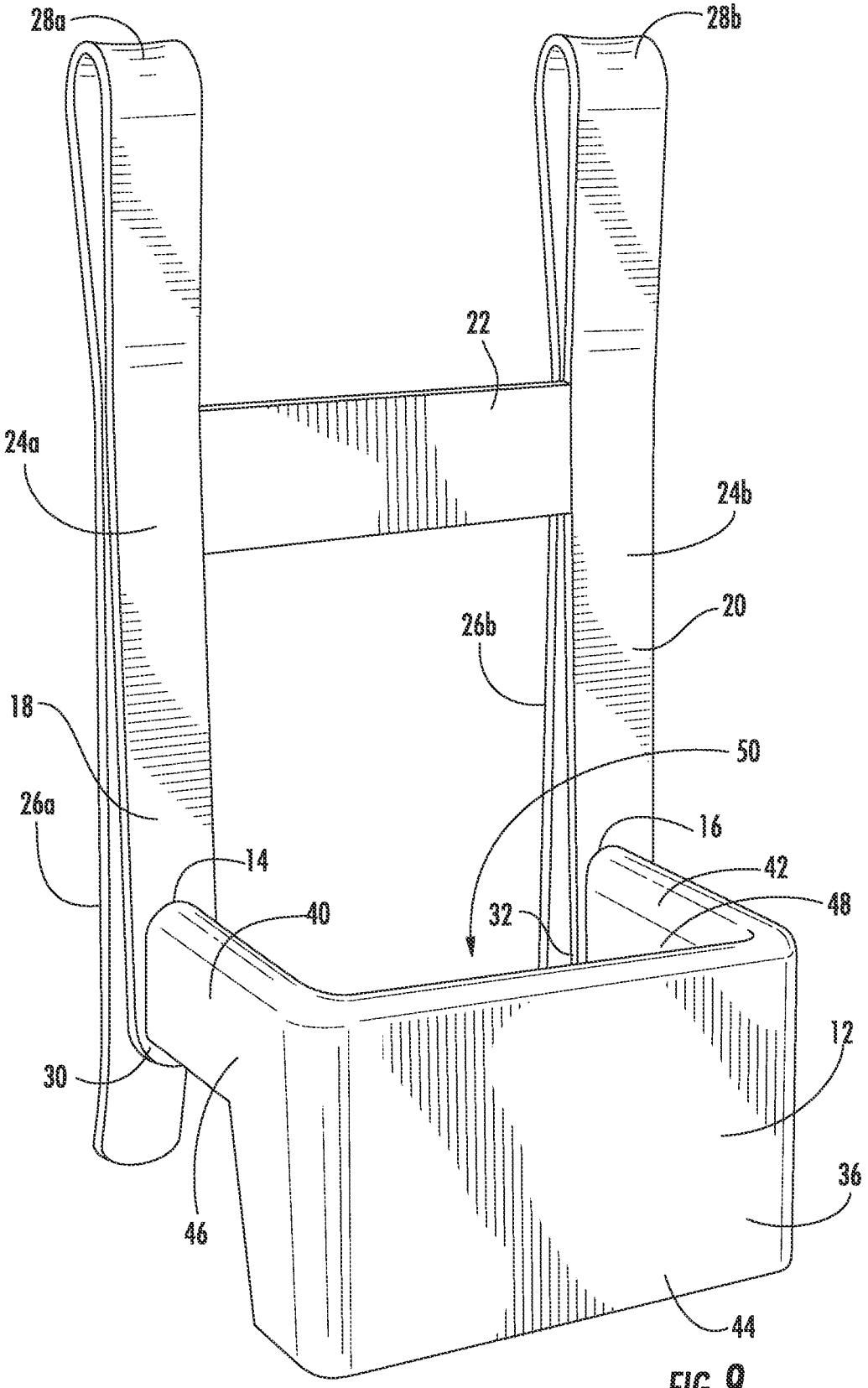
FIG. 9 is a front, perspective view of an embodiment of a clip-on air gun holster as described herein, where the support arm strip extends continuously from the first leg to the second leg of the holster.
Figure 10:
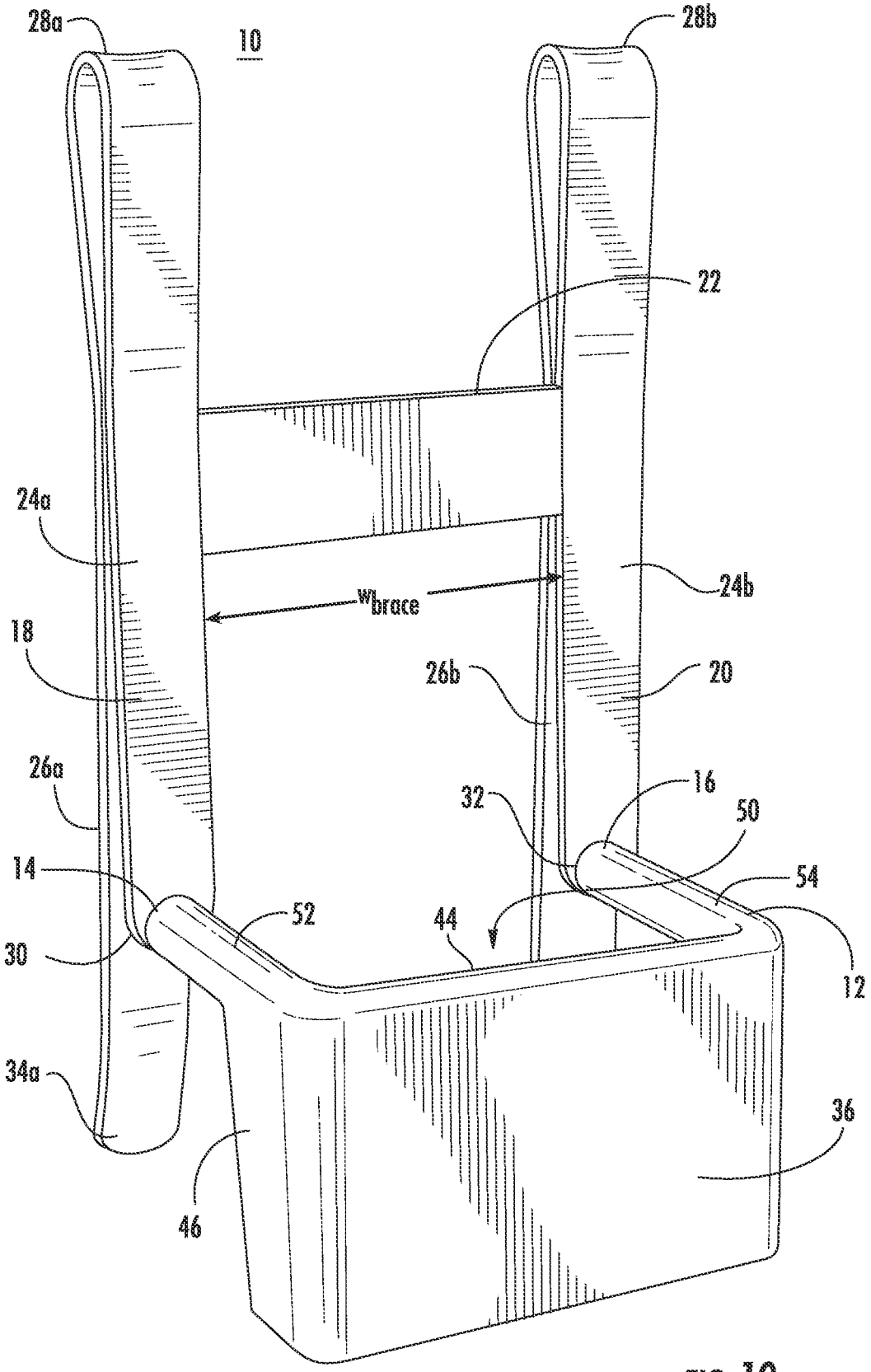
FIG. 10 is a front, perspective view of an embodiment of a clip-on air gun holster as described herein, where the support arm strip is coupled to the first leg by a first projection and the second leg by a second projection.

In some embodiments, as shown in FIG. 9, the support arm sides 40, 42 can be attached directly to the first and second legs 18, 20. As shown in FIG. 9, in some embodiments, the support arm strip 36 can be the support arm 12, where the support arm sides 40, 42 and the support arm strip 36 have a continuous even top edge 58. The clip-on air gun holster of FIG. 9 is symmetric around a vertical axis. In some embodiments, the support arm sides 40, 42 are thicker than the support arm strip 36. In other embodiments, the support arm strip 36 has a uniform thickness ($t_{SAS}$) equal to the thickness of the first and second support arm sides 40, 42.

In some embodiments, as shown in FIGS. 10-13, the projections 50, 52 serve as the support arm sides 40, 42 and are connected to the support arm strip 36. In some embodiments, the support arm 12 comprises a first projection 50 extending generally perpendicular from the first leg 18 and a second projection 52 extending generally perpendicular from the second leg 20, and a transverse member 44 extending from a distal end of the first projection 50 to a distal end of the second projection 52. The portion of the transverse member 44 extending from the first projection 50 to the second projection 52 can be perpendicular to both the first projection 50 and the second projection 52.

In some embodiments, the support arm 12 includes a support arm bar 38 extending from a lower end 30 of the front piece 24*a* of the first leg 18 to a lower end 32 of the front piece 24*b* of the second leg 20, where the support arm strip 36 extends down from the support arm bar 38. The support arm bar 38 can be formed of a bar with a uniform cross-section (e.g., circular), which may deviate from a uniform cross-section where the support arm bar is bent.

In some embodiments, the length ($L_{proj}$) of the first projection 50 and the second projection 52 can, independently, be between 0.25 inches and 2.5 inches. In some embodiments, the length ($L_{proj}$) of the first projection 50 and the second projection 52 can, independently, be at least 0.25 inches, at least 0.5 inches, at least 0.75 inches, or at least 1 inch. In some embodiments, the length ($L_{proj}$) of the first projection 50 and the second projection 52 can, independently, be 3 inches or less, 2.5 inches or less, 2 inches or less, 1.75 inches or less, 1.5 inches or less, or 1.125 inches or less.

Figure 11:
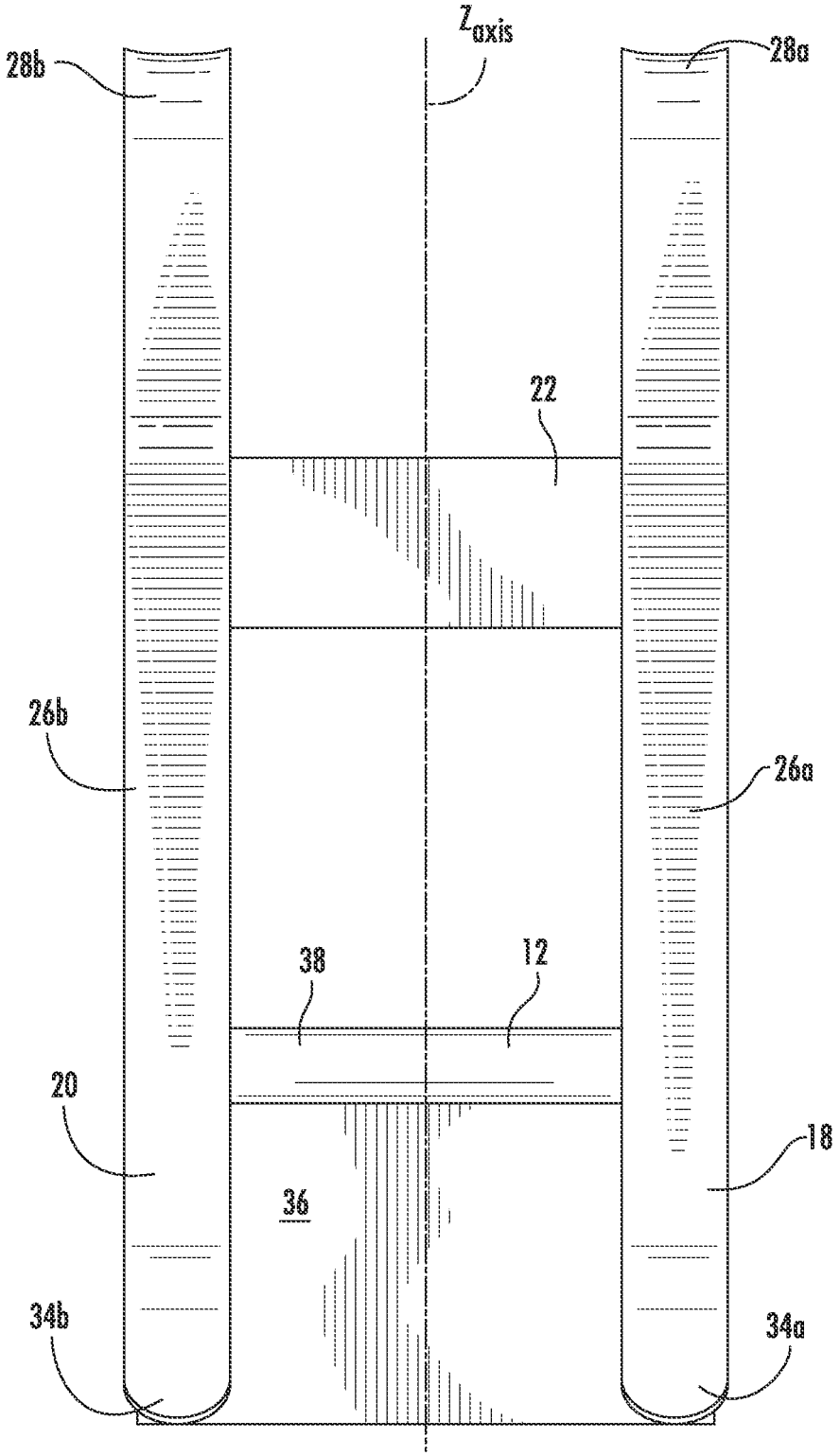
FIG. 11 is a back view of a clip-on air gun holster where the support arm includes a continuous support arm bar.
Figure 12:
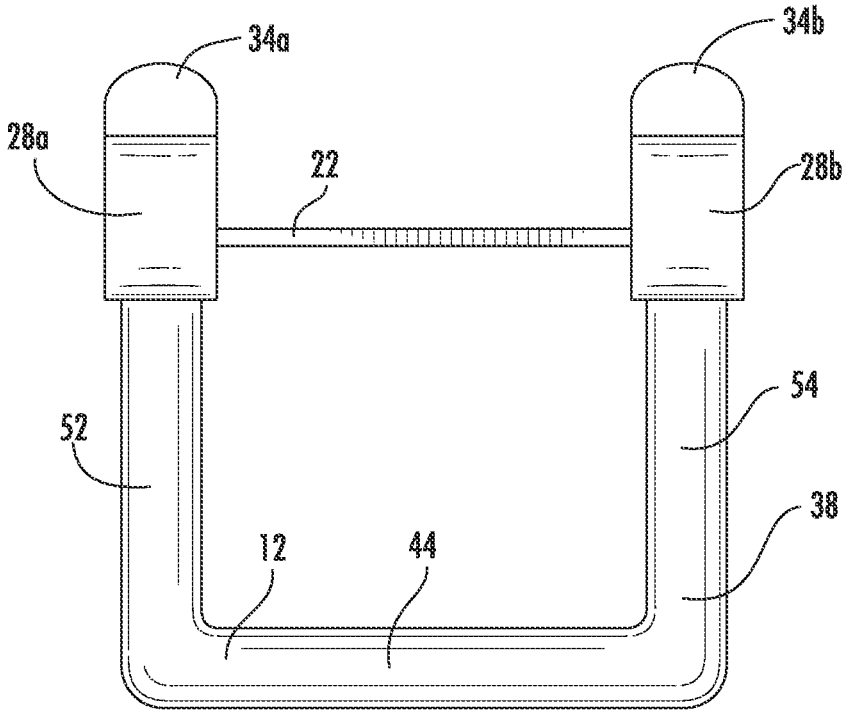
FIG. 12 is a top view of the clip-on air gun holster of FIG. 11.
Figure 13:
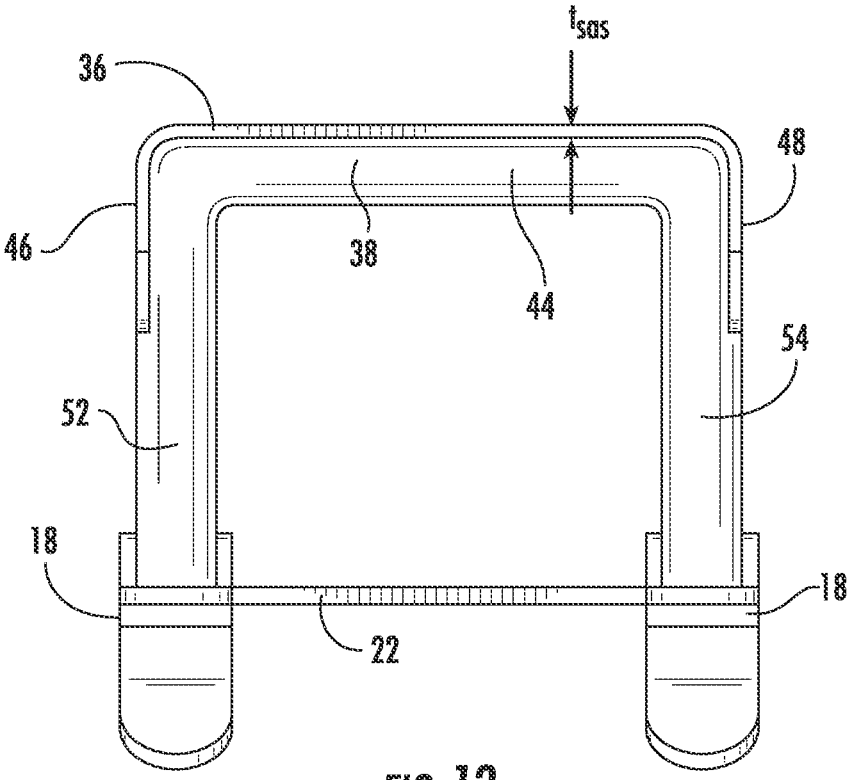
FIG. 13 is a bottom view of the clip-on air gun holster of FIG. 11.

In some embodiments, as best shown in FIGS. 11, 12, & 13, the first projection 50, the second projection 52, and the transverse member 44 are all formed from a single bar 38, while the support arm strip 36 extends down from the first projection 50, the second projection 52, and the transverse member 44.

As best shown in FIG. 13, in some embodiments, the support arm 12 includes a first projection 50 extending generally perpendicular from the first leg 18 and a second projection 52 extending generally perpendicular from the second leg 20, where the support arm strip 36 extends from a distal end of the first projection 50 to a distal end of the second projection 52. In some embodiments, the first projection 50, the second projection 52, and the transverse member 44 are not formed from a bar with a generally uniform cross-section, rather the transverse member 44 is the support arm strip 36, which is a sheet of material with a generally uniform thickness ($t_{SAS}$). In such embodiments, a first support arm strip side 46 can extend along the first projection 50, a second support arm strip side 48 can extend along the second projection 52 and an intermediate portion of the support arm strip 36 can form the transverse member 44.

In order to appreciate the benefits of the clip-on air gun holster 10 described herein, it is important to understand how the device works. Current air guns are sold with plastic clips that quickly break off. These hooks are generally used in connection with hooks and conventional hammer holder loops or rings.

Figure 8:
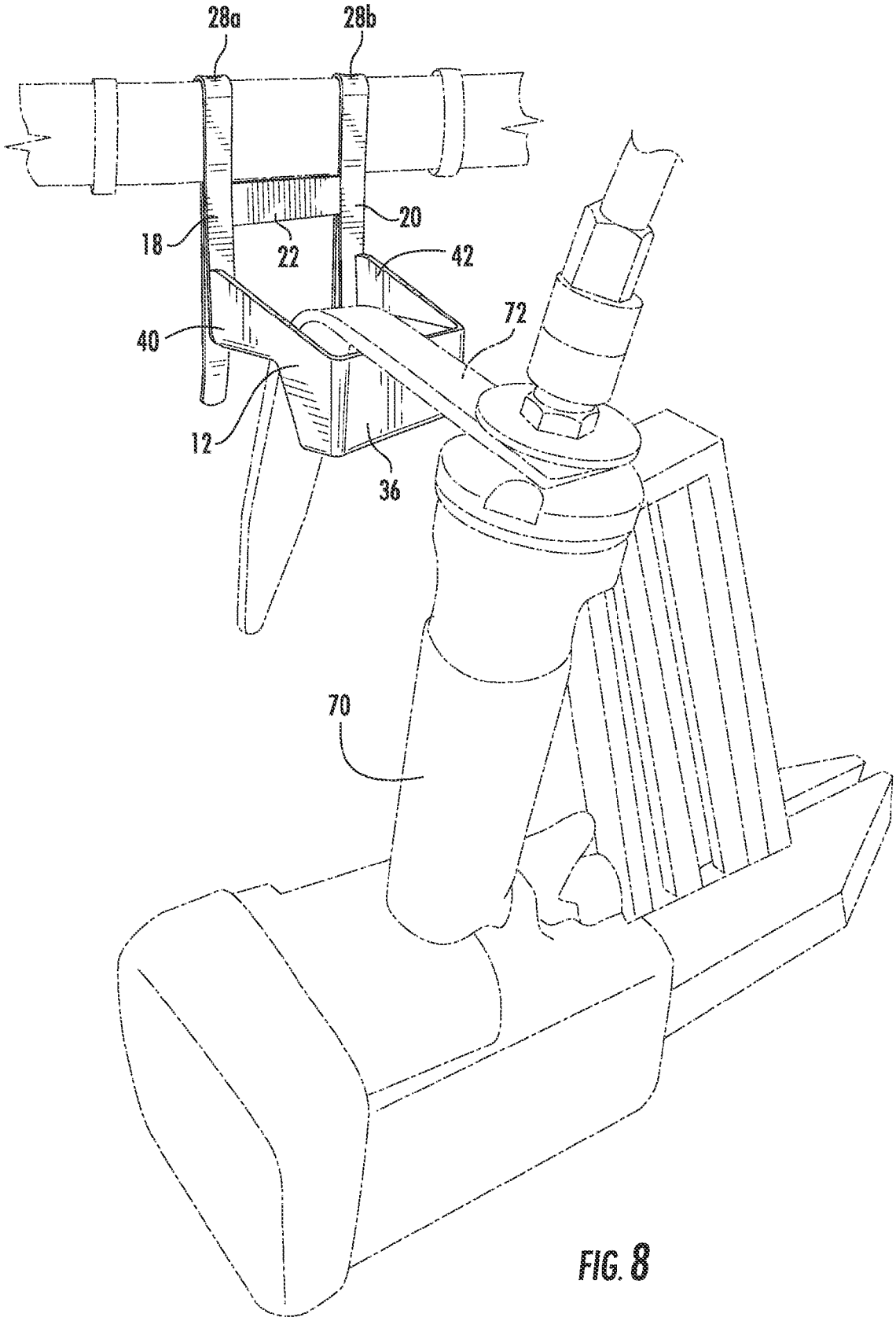
FIG. 8 is an environmental view showing an air gun supported from a clip-on air gun holster as disclosed herein.

The clip-on air gun holster 10 is designed to be used with an air gun 70 with a bracket 72 (such as an L-shaped bracket) attached to it. The bracket 72 can be attached to a distal end of the handle of the air gun, as shown in FIG. 8. The bracket 72 can include a hole at a first end and, as shown in FIG. 8, an air supply line connector can pass through the hole to secure the bracket 72 to the air gun when the air supply line connector is attached to an air supply line input of the air gun (generally at the distal end of the handle). A free end of the bracket 72 can extend generally parallel to the air gun handle and can be generally tapered. In some embodiments, the air gun holster pouch 2 can be sold with such a bracket 72 for attachment to an air gun supply line.

In use, the clip-on air gun holster 10 can be secured to an object, such as the user's belt, as shown in FIG. 8. When the user is not using the air gun, the user simply slides the free end of the bracket 72 into the support arm opening 50. The support arm opening 50 is designed to provide a relatively tight fit for the L-shaped bracket. The flat shape and height ($h_{SAS}$) of the support arm strip 36 are designed to limit the air gun from sliding around when being worn by a worker and prevent accidental releases when the user moves (e.g., bends down to adjust a truss. The length ($L_{proj}$) of the first and second projections 40, 42 is also limited to prevent the air gun from sliding around when being worn by a worker. Finally, the length of the legs 18, 20 is designed so that, when worn, the air gun 70 will rest against the user's leg above the knee. This allows the worker to control the air gun without using their hands when walking high up on a truss or other elevated structure.

The foregoing is provided for purposes of illustrating, explaining, and describing embodiments of this invention. Modifications and adaptations to these embodiments will be apparent to those skilled in the art and may be made without departing from the scope or spirit of this invention.

What is claimed is:

1. A clip-on air gun holster comprising:

a support arm, having a first end spaced apart from a second end;

a first leg extending generally perpendicular to said first end;

a second leg extending generally perpendicular to said second end; and a bracing arm spaced apart from said support arm and extending from said first leg to said second leg, wherein said first leg and said second leg each comprise a front piece and a back piece opposite said front piece, wherein each front piece-back piece pair is connected at an upper end by a loop, wherein the support arm comprises a support arm strip that is continuous, flat, and has a uniform thickness, wherein the support arm comprises a first projection extending generally perpendicular from the first leg, a second projection extending generally perpendicular from the second leg, and a transverse member extending from a distal end of the first protection to a distal end of the second projection, wherein first and second terminal edges of the support arm strip are located at an intermediate portion of the first and second projections, respectively, and wherein the first and second angled edges define a transition zone from side portions of the lower edge of the support arm strip proximate the first and second leg, respectively, and a bracket engaging portion of the lower edge that extends along the transverse member and extends below the side portion.

2. The clip-on air gun holster according to claim 1, wherein said first leg is coupled to said first end at a lower end of the front piece of the first leg, and said second leg is coupled to said second end at a lower end of the front piece of the second leg.

3. The clip-on air gun holster according to claim 2, wherein said bracing arm is coupled to and extends from the front piece of the first leg to the front piece of the second leg, wherein the bracing arm is between said support arm and said loops.

4. The clip-on air gun holster according to claim 1, wherein the back pieces of the first and second legs are not connected by a component extending between the back pieces.

5. The clip-on air gun holster according to claim 1, wherein lower ends of the back pieces of the first and second legs are not connected by a component extending between the back pieces.

6. The clip-on air gun holster according to claim 1, wherein the first leg and the second leg are formed by an elastic material.

7. The clip-on air gun holster according to claim 1, wherein the front piece, loop, and back piece of each leg is formed from a strip of elastic material.

8. The clip-on air gun holster according to claim 7, wherein material forming the first leg and the material forming the second leg are flat and have a uniform leg thickness.

9. The clip-on air gun holster according to claim 8, wherein the bracing arm is formed of a flat strip of material that has a uniform strip thickness.

10. The clip-on air gun holster according to claim 1, wherein said first projection comprises a first support arm strip side, said first projection comprises a second support arm strip side and an intermediate portion of said support arm strip forms a transverse member extending from a distal end of the first projection to a distal end of the second projection.

11. The clip-on air gun holster according to claim 10, wherein the transverse member extends generally perpendicular to said first projection and said second projection.

12. The clip-on air gun holster according to claim 1, an upper edge of the support arm is angled downward when starting at the end proximate the first leg; an upper edge of the support arm is angled downward when starting at the end proximate the second leg; or both.

13. The clip-on air gun holster according to claim 1, wherein a height of the support arm strip extending from the distal end of the first projection to the distal end of the second projection ranges from 0.75 inches to 4 inches.

14. The clip-on air gun holster according to claim 1, wherein the loops are at a top end of the clip-on air gun holster, the lower edge of the support arm proximate the first leg is above the lower edge of the support arm proximate the transverse member, and the lower edge of the support arm proximate the second leg is above the lower edge of the support arm proximate the transverse member.

15. The clip-on air gun holster according to claim 1, wherein the support arm strip comprises the transverse member.

16. The clip-on air gun holster according to claim 1, wherein side portions of the lower edge on either side of the transition zone are not angled.

17. The clip-on air gun holster according to claim 1, wherein side portions of the lower edge on either side of the transition zone are parallel.

18. A clip-on air gun holster comprising:

a support arm, having a first end spaced apart from a second end;

a first leg extending generally perpendicular to said first end;

a second leg extending generally perpendicular to said second end; and a bracing arm spaced apart from said support arm and extending from said first leg to said second leg, wherein said first leg and said second leg each comprise a front piece and a back piece opposite said front piece, wherein each front piece-back piece pair is connected at an upper end by a loop, wherein the support arm comprises a support arm strip that is continuous, flat, and has a uniform thickness, wherein a first support arm strip side extends generally perpendicular from the first leg, a second support arm strip side extends generally perpendicular from the second leg, and a support arm strip transverse member extending from a distal end of the first support arm strip side to a distal end of the second support arm strip side, wherein a lower edge of the first support arm strip side proximate the first leg and lower edge of the second support arm strip side proximate the second leg are above a lower edge of the support arm strip across the support arm strip transverse member, and intermediate portion of the lower edge of each of the first and second support arm strip sides form an angled transition from the lower edge of the first and second support arm strips sides that are above the lower edge of the support arm strip transverse member.

* * * * *